US006241002B1

(12) United States Patent
Russell et al.

(10) Patent No.: US 6,241,002 B1
(45) **Date of Patent: *Jun. 5, 2001**

(54) CASTING STEEL STRIP

(75) Inventors: Wayne Russell, Wollongong (AU); Heiji Kato, Yokosuka (JP)

(73) Assignees: Ishikawajima-Harima Heavy Industries Company Limited, Tokyo (JP); BHP Steel (JLA) Pty Ltd., Sydney NSW (AU)

( * ) Notice: Subject to any disclaimer, the term of this patent is extended or adjusted under 35 U.S.C. 154(b) by 0 days.

This patent is subject to a terminal disclaimer.

(21) Appl. No.: 09/293,157

(22) Filed: Apr. 16, 1999

(30) Foreign Application Priority Data

May 4, 1998 (AU) ..... PP3316

(51) Int. Cl.[7] ..... B22D 11/124
(52) U.S. Cl. ..... 164/428; 164/442; 164/448
(58) Field of Search ..... 164/428, 480, 164/448, 442, 348; 492/46

(56) References Cited

U.S. PATENT DOCUMENTS 5,887,644 * 3/1999 Akiyoshi et al. ..... 164/428
5,996,680 * 12/1999 Fukase et al. ..... 164/448

FOREIGN PATENT DOCUMENTS

2121919 * 1/1992 (GB) ..... 492/46
4036121 * 1/1992 (DE) ..... 492/46

* cited by examiner

*Primary Examiner*—Kuang Y. Lin
(74) *Attorney, Agent, or Firm*—Miles & Stockbridge P.C.; John C. Kerins

(57) ABSTRACT

An arbourless casting roll for casting steel strip includes a cylindrical tube (20) of copper of copper alloy having a wall thickness in the range of 30 mm–200 mm and a series of holes defining longitudinal water flow passages (26). A pair of steel stub shafts (21, 22) disposed one at each end of tube (20) have end formations (27, 28) which fit snugly into the ends of tube (20) and have circumferential flanges (29, 30) abutting the ends of the tube. Fasteners (71) extend through flanges (29, 30) into at least some of the holes (26) to fix the stub shafts to the tube (20) such that the tube is unsupported between the stub shafts (21, 22). Water flow ducts (35, 36( in the stub shaft end formations (27, 28) allow flow of water to and from the flow passages (26).

18 Claims, 6 Drawing Sheets

CASTING STEEL STRIP

BACKGROUND OF THE INVENTION

This invention relates to the casting of thin steel strip and has particular application to the construction of casting rolls used in twin roll strip casters.

In a twin roll caster molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel or series of vessels from which it flows through a metal delivery nozzle located above the nip so as to direct it into the nip between the rolls, so forming a casting pool of molten metal supported on the casting surfaces of the rolls immediately above the nip. This casting pool may be confined between side plates or dams held in sliding engagement with the ends of the rolls. The casting surfaces of the casting rolls are generally provided by outer circumferential walls provided with longitudinal cooling water passages to and from which water is delivered through generally radial passages in end walls of the rolls.

When casting ferrous metals the rolls must support molten metal at very high temperatures of the order of 1640° C. and their peripheral surfaces must be maintained at a closely uniform temperature throughout in order to achieve uniform solidification of the metal and to avoid localised overheating of the roll surface. It has therefore been normal to form the outer circumferential wall of each casting roll as copper or copper alloy sleeve mounted on a central stainless steel arbour and provided with closely spaced longitudinal water flow passages supplied with cooling water through water flow ducts formed in the supporting arbour. Such a roll construction is disclosed in our co-pending Australian Patent Application PO8328. In that roll construction the water flow passages are formed by circumferentially spaced holes drilled through a copper or copper alloy sleeve mounted on a central stainless steel arbour. The ends of the holes are all plugged to seal the water flow passages and the water flow passages are interconnected in groups such that each group of circumferentially spaced passages forms a single continuous water flow channel for flow of water back and forth between the two ends of the roll in passing from one end of the channel to the other. This enables a very even temperature distribution to be achieved both circumferentially and longitudinally of each casting roll.

Although the roll construction disclosed in Application PO8328 makes it possible to achieve a very even temperature distribution over the casting roll surface, it has been found that there are roll distortion and movement problems caused by the differential expansion of the copper sleeve and the supporting stainless steel arbour. The wall of the copper sleeve expands to a slightly greater radius at the side where it is in contact with the casting pool as compared with its side remote from the casting pool so that the sleeve develops a non-circular, generally oval cross section. This causes some parts of the sleeve to lose firm contact with the arbour during each revolution. The extent to which this occurs can vary along the roll so that the points of firm contact can be at arbitrary and varying positions along the roll. When the sleeve contracts on leaving contact with the casting pool during each revolution it will tend to contract towards the firm contact points and since these can be at arbitrary varying locations the sleeve can be caused to move longitudinally. Accordingly, the sleeve not only floats on the arbour in radial directions to produce gap control problems but it also suffers arbitrary longitudinal movements with consequent side dam control problems.

The floating movements of the copper sleeves on the arbours also causes the centre line of the gap between the rolls to move laterally back and forth during casting. Generally one of the roll arbours is set to be moveable under a constant spring bias which determines the gap between the rolls during casting. However, if the centre line of the gap moves due to movements of the sleeves relative to the arbours the spring loaded arbour will also move. Accordingly, even though a constant spring bias may be maintained there will be constant movements of the spring loaded arbour and a shifting of the gap position leading to gauge variations in the cast strip ie. the thickness of the strip fluctuates continuously as it is formed.

The present invention enables the above problems to be overcome by providing a new casting roll construction in which there is no central supporting arbour, the casting surface being provided by a copper or copper alloy tube which is connected directly to a pair of stub shafts making use of fasteners fitted into cooling passage holes in the roll tube.

SUMMARY OF THE INVENTION

According to the invention there is provided an arbourless casting roll for casting steel strip including:

- a cylindrical tube of copper or copper alloy having a wall thickness in the range of 30 mm–200 mm;
- a series of longitudinal holes through the wall of the tube defining longitudinal water flow passages arranged at equal circumferential spacing around the tube;
- a pair of steel stub shafts disposed one at each end of the tube and having end formations which fit snugly into the ends of the tube, each end formation including a circumferential flange abutting the respective end of the tube;
- a plurality of fasteners extending through the circumferential flanges of the end formations of the stub shafts into the ends of at least some of the said holes to fix the stub shafts to the tube such that the stub shafts and the tube are coaxial and the wall of the tube is unsupported between the stub shafts; and
- water flow ducts formed in at least one of the stub shaft end formations for flow of water to and from the longitudinal water flow passages.

Preferably the water flow ducts extend radially within both of the stub shaft end formations and through the ends of the tube to connect with the water flow passages for flow of water to and from the longitudinal water flow passages.

Preferably too, the longitudinal holes providing the water flow passages are circular holes which are closely spaced so as to be spaced apart by no more than the maximum diameter of the holes.

Preferably further the longitudinal water flow passages are interconnected groups such that each group of circumferentially spaced passages forms a single continuous water flow channel for flow of water back and forth between the two ends of the roll in passing from one end of the channel to the other.

More specifically the longitudinal passages may be interconnected in groups of three defining three-pass water flow channels. In that case the water flow ducts may comprise a first set of radial ducts extending through one of the stub shaft end formations to communicate with first ends of the water flow channels and a second set of radial ducts extending through the other of the stub shaft end formations to communicate with the opposite ends of those channels.

The fasteners may extend into the water flow passage holes at the ends of said water flow channels. The ends of the holes at the interconnections between water flow passages intermediate the ends of the water flow channels may be closed by end plugs.

Preferably further the ends of said tube are provided with external circumferential end notches so-as to form a relatively thick walled main part defining the roll casting surface between a pair of shoulders to engage casting pool confining walls in use of the roll. Preferably further, said shoulders are spaced inwardly from the stub shaft end formations.

The invention also extends to apparatus for continuously casting steel strip comprising an assembly of a pair of casting rolls forming a nip between them and each provided with water flow passages extending adjacent the outer peripheral surfaces of the rolls longitudinally of the rolls, a metal delivery nozzle for delivery of molten metal into the nip between the casting rolls to form a casting pool of molten steel supported on the casting roll surfaces above the nip, a pair of pool confining walls engaging opposite end parts of the rolls to confine the pool at the ends of the nip, roll drive means to drive the casting rolls in counter-rotational directions to produce a solidified strip of steel delivered downwardly from the nip and cooling water supply means for supply of cooling water to said longitudinal passages in the rolls, wherein each casting roll comprises a cylindrical tube of copper or copper alloy having a wall thickness in the range 30 mm–200 mm, a series of longitudinal water flow passages in the wall of the tube arranged at equal circumferential spacing around the tube, a pair of stub shafts disposed one at each end of the tube and having end formations which fit snugly into the ends of the tube, each end formation including a circumferential flange abutting the respective end of the tube, a plurality of fasteners extending through the circumferential flanges of the end formations of the stub shafts into the ends of at least some of the said holes to fix the stub shafts to the tube such that the stub shafts and the tube are coaxial and the wall of the tube is unsupported between the stub shafts; and water flow ducts formed in at least one of the stub shaft end formations for flow of water to and from the longitudinal water flow passages.

BRIEF DESCRIPTION OF THE DRAWINGS

In order that the invention may be more fully explained one particular embodiment will be described in some detail with reference to the accompanying drawings in which.

DESCRIPTION OF THE PREFERRED EMBODIMENT

Figure 1:
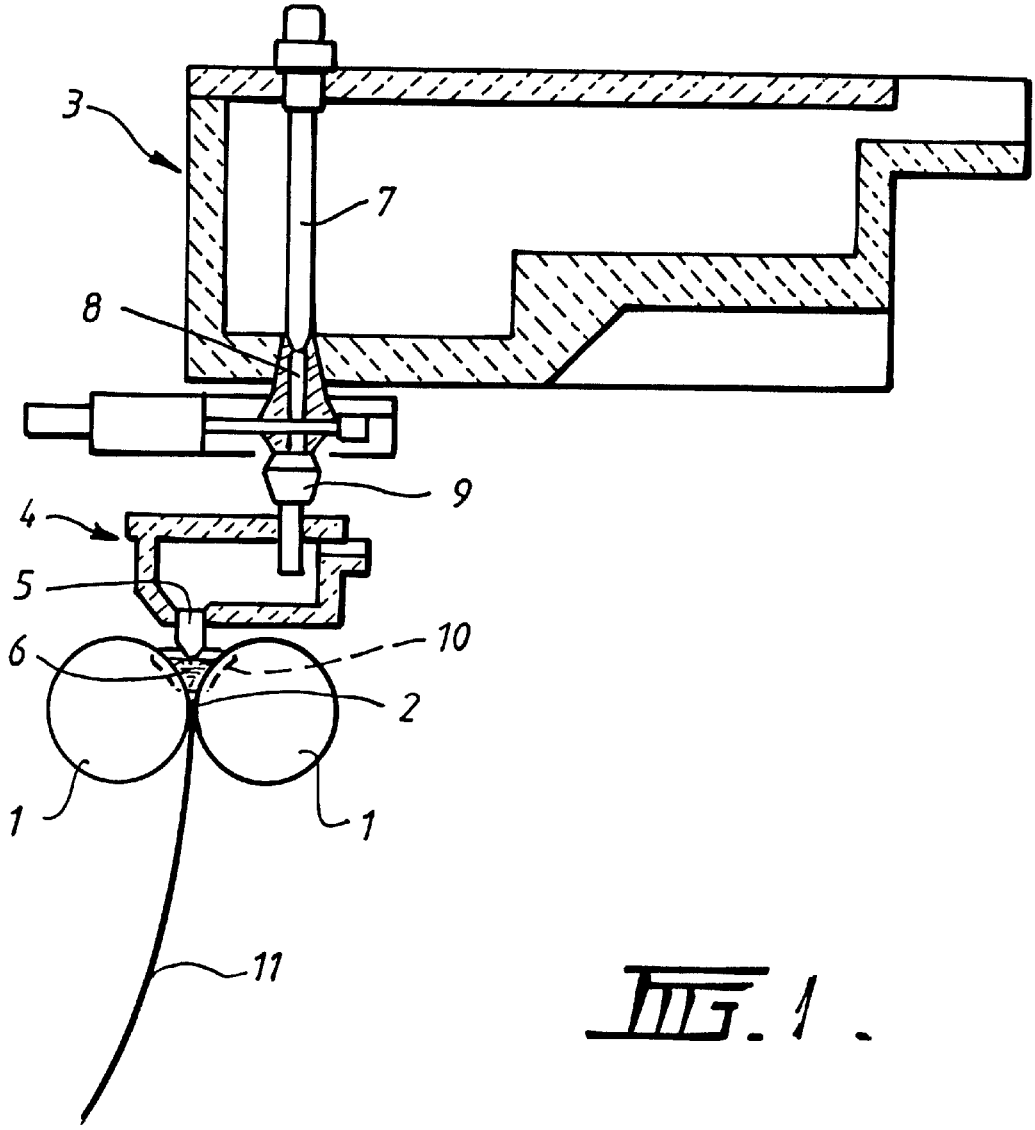
FIG. 1 is a vertical cross-section through a strip caster constructed in accordance with the invention.
Figure 2A:
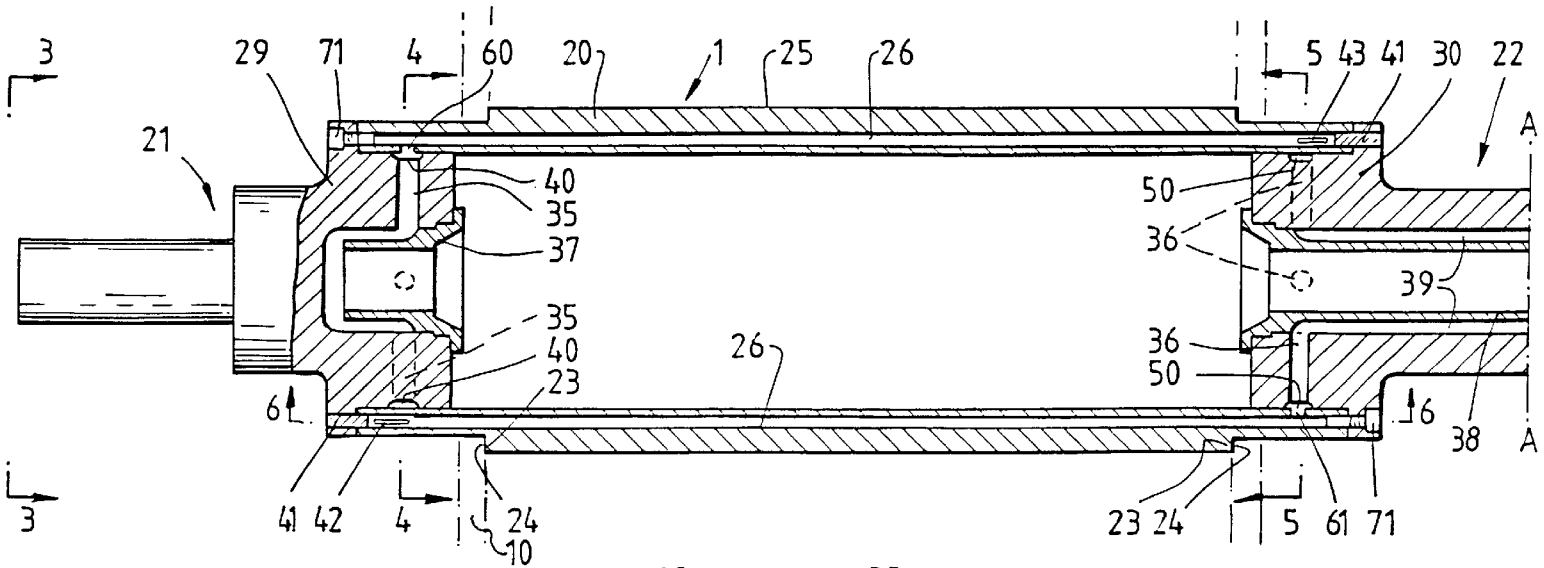
FIGS. 2A and 2B join on the line A—A to form a cross-section through one of the casting rolls of the caster illustrated in FIG. 1.
Figure 2B:
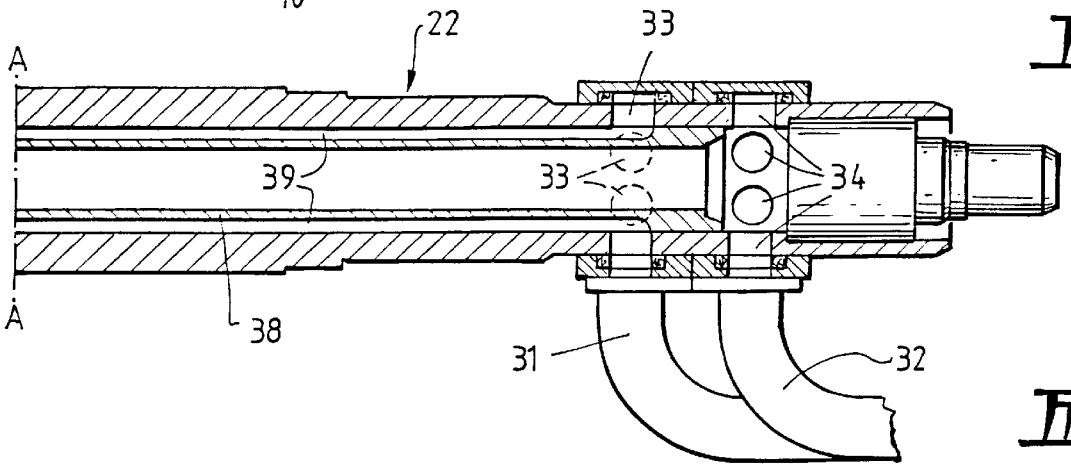
Figure 3:
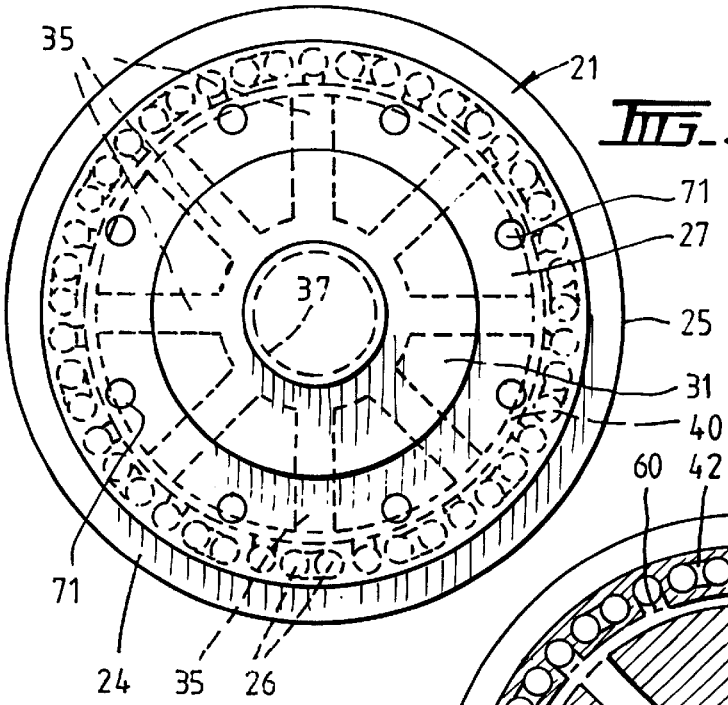
FIG. 3 is a view on the line 3—3 in FIG. 2.
Figure 4:
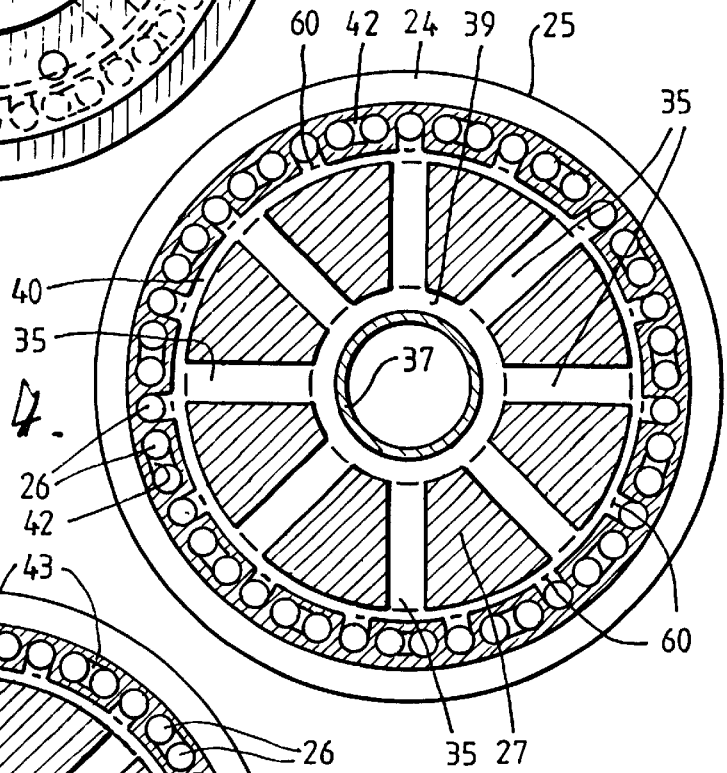
FIG. 4 is a cross-section on the line 4—4 in FIG. 2.
Figure 5:
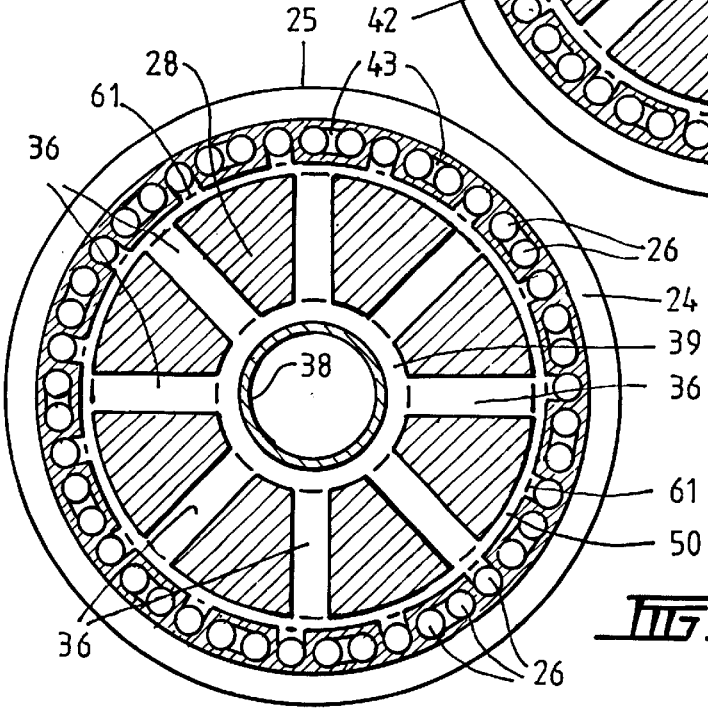
FIG. 5 is a cross-section on the line 5—5 in FIG. 2.

The illustrated strip caster comprises a pair of twin casting rolls 1 forming a nip 2 between them. Molten metal is supplied during a casting operation from a ladle (not shown) via a tundish 3, distributor 4 and a delivery nozzle 5 into the nip between rolls 1 so as to produce a casting pool 6 of molten metal above the nip. The ends of the casting pool are confined by a pair of refractory confining plates 10 which engage notched ends of the rolls as described below. Tundish 3 is fitted with a stopper rod 7 actuable to allow the molten metal to flow from the tundish through an outlet nozzle 8 and a refractory shroud 9 into distributor 4.

Casting rolls 1 are provided in a manner to described in detail below with internal water cooling passages and they are contra-rotated by drive means (not shown) to produce a continuous strip product 11 which is delivered downwardly from the nip between the casting rolls.

As thus far described the illustrated apparatus is as more fully described in granted U.S. Pat. No. 5,184,668 and Australian Patent 664670. Reference may be made to these patents for full constructional and operational details of the apparatus.

The two casting rolls 1 are of identical construction and are formed in accordance with the present invention. Each is formed by a solid tube 20 of copper or copper alloy which is mounted between a pair of stainless steel stub shafts 21, 22 such that the stub shafts and tube are fixed together in a coaxial relationship to form the casting roll. Tube 20 is provided with a series of longitudinal water flow passages 26 formed by drilling long holes through copper tube from one end to the other, the ends of the hole subsequently being closed by end plugs and stub shaft fixing screws in a manner to be described below.

Tubular roll body 20 is provided with end notches 23 so as to have a main relatively thick walled portion defining the outer casting surface 25 of the roll between a pair of shoulders 24 to engage the refractory confining plates 10.

Stub shafts 21 and 22 have end formations 27, 28 which fits snugly within the ends of the tubular roll body 20 and include circumferential flanges 29, 30 which abut the outer ends of roll body tube 20. The stub shafts are fixed to the ends of the body tube 20 by screw fasteners 71 extended through holes in the flanges 29, 30 and into screw tapped ends of some of the longitudinal holes defining the water passages 26, the remaining hole ends being closed by screw plugs 41 as described below.

Stub shaft 22 is much longer than stub shaft 21 and it is provided with two sets of water flow ports 33, 34 for connection with rotary water flow couplings 31, 32 by which water is delivered to and from the roll. The cooling water passes to and from the longitudinal water flow passages 26 via radial passages 35, 36 extending through the stub shaft end formations 27, 28 and the ends of the roll tube 20 to connect with annular galleries 40 and 50 which are formed in the outer periphery of body 20 and which provide communication with the longitudinal passages around the circumference of the roll. The stub shafts 21, 22 are fitted central spacer tubes 37, 38 to define separate internal water flow ducts within the roll for the inflowing and outflowing water. In this way the ports 33 communicate through an annular duct 39 disposed outside the tube 38 with the radial flow passages 36 whereas the radial flow passages 35 communicate through a duct formed by the hollow interior of the roll and the interior of tube 38 with the water flow ports 34. As discussed below the water flow ports 33, 34 may be connected to water supply and return line so that water may flow to and from the roll in either direction.

As already mentioned, water flow passages 26 are formed by drilling long holes through the tubular roll body 20 and plugging the ends of the holes by the stub shaft fixing screws 71 and the end plugs 41. The number of stub shaft fixing screws 71 and end plugs 41 can be varied and may conveniently be chosen according to the desired grouping of passages to provide a multi-pass flow of cooling water across the roll. In the illustrated construction, end connections are made between adjacent passages 26 at the two ends of the roll body tube to interconnect groups of three successive holes to form a continuous zigzag water flow channel to provide for back and forth flow of cooling water across the roll between the radial passages 35 and 36.

Figure 6:
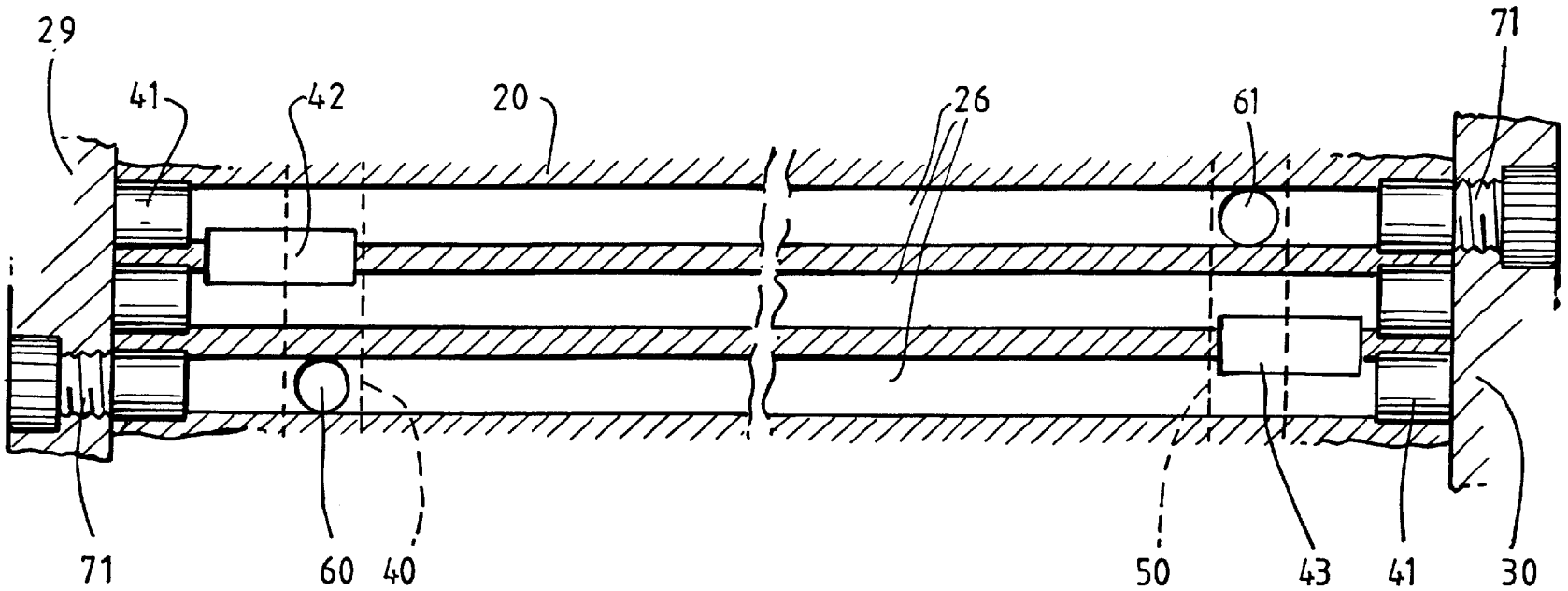
FIG. 6 is a scrap view generally on the line 6—6 in FIG. 2.

As most clearly seen in FIG. 6 the first and second holes of each group of three holes is joined by interconnecting side gallery 42 at one end of the roll and the second and third holes are joined by interconnecting side gallery 43 at the other end of the roll. The ends of the zigzag channels connect via radial holes 60, 61 in the outer sleeve and the annular galleries 40, 50 with the radial passages 35, 36. In this way there is a multi-pass flow of cooling water between the ends of the rolls. More specifically the water flows from one set of radial passages along the roll in one direction to the other end of the roll, then back to the original end of the roll before returning back to the other end of the roll to leave the roll via the radial passages at that other end of the roll. With this arrangement every third longitudinal hole end can be used as a fixing point for the stub shaft fasteners 71 and the intermediate pairs of hole ends are sealed by end plugs 41.

Because of the multi-pass arrangement, cooling water which has absorbed heat in passing from one end of the roll to the other is returned to the original end of the roll at a higher temperature before passing to the exit end of the roll. This causes the average temperature of the water at the original end of the roll to be raised and so reduces the temperature differential between the two ends of the roll.

The galleries 42, 43 interconnecting adjacent longitudinal passages 26 can be formed by inserting side cutting tools in the ends of the holes and moving those tools sideways to form the interconnecting galleries before the ends of the holes are plugged.

Even cooling of the ends of the casting surfaces 25 is particularly critical and difficult to achieve. For this reason the shoulders 24 which engage with the pool confining or damming refractory side plates 10 are spaced inwardly from the stub shafts 21, 22. With this arrangement the cooling water flows in essentially straight line unobstructed paths substantially throughout the effective length of the casting surfaces between the pool confining side plates 10 so as to promote uniform cooling throughout the casting surfaces. Moreover, the stub shafts are set well back from the main part of the roll body tube and accordingly are not substantially affected by the thermal effects in the body tube during casting.

Figure 7:
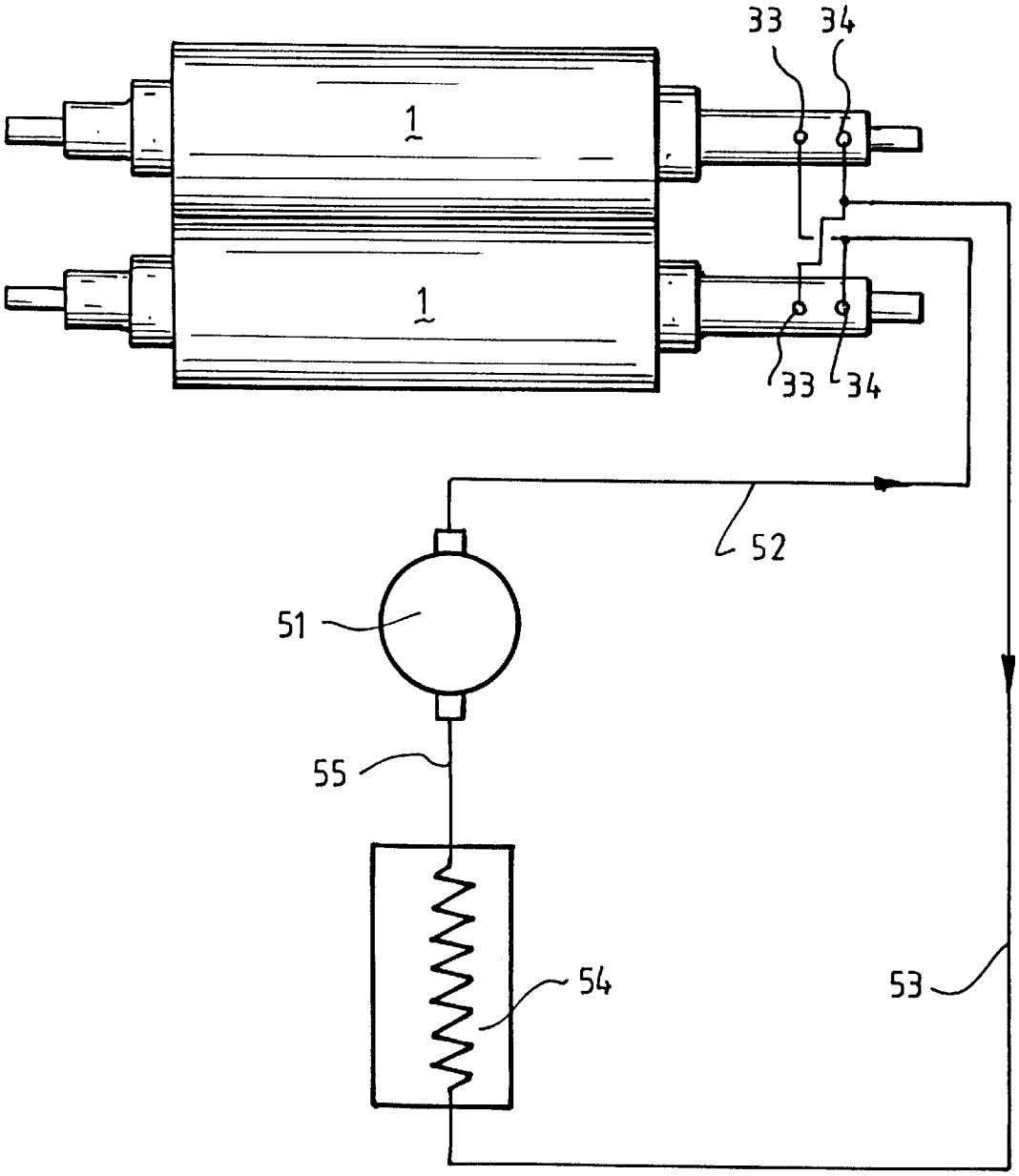
FIG. 7 illustrates one manner in which a water supply may be connected to cooling water passages in the casting rolls in accordance with the present invention.
Figure 8:
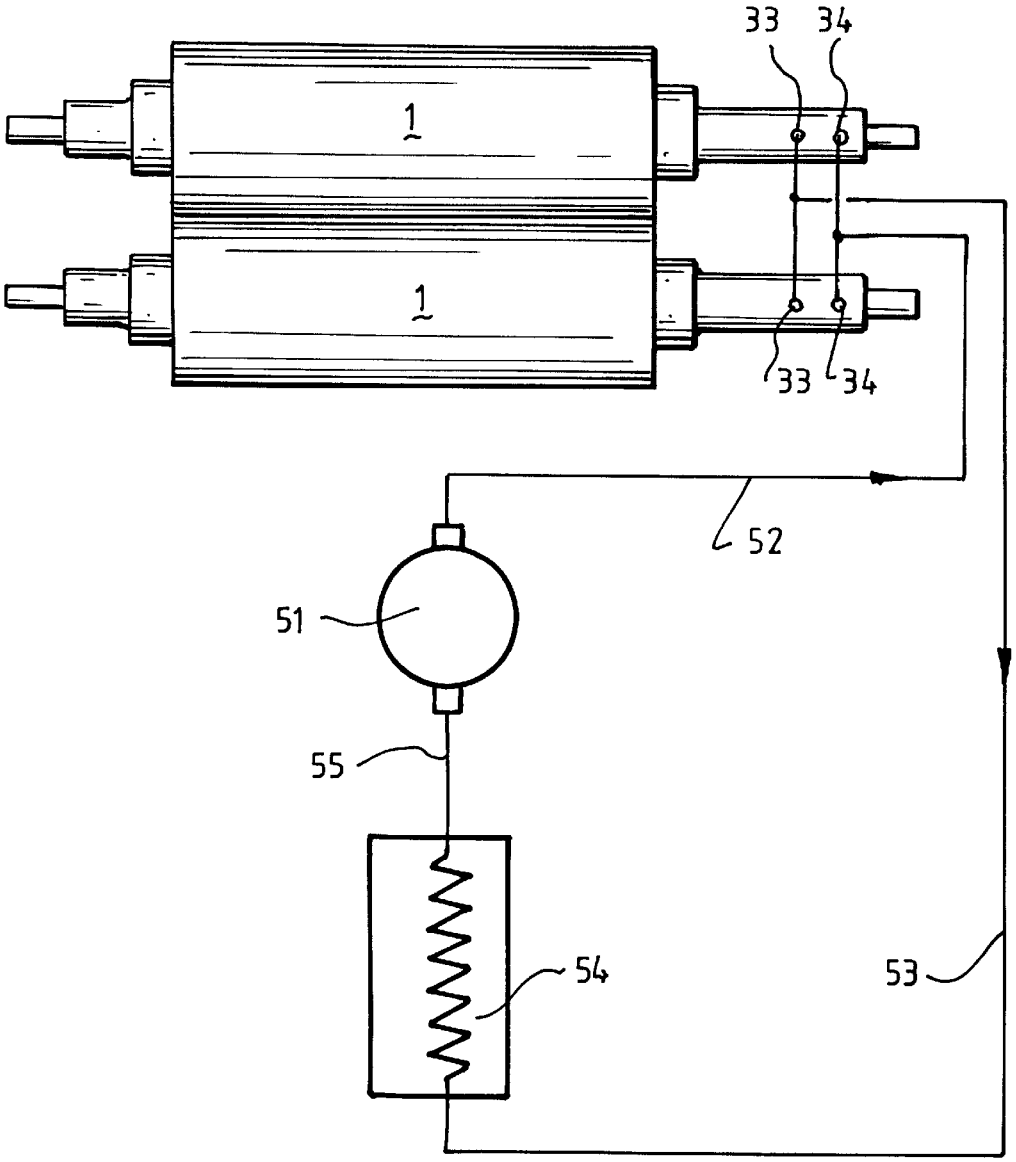
FIG. 8 illustrates an alternative manner of connecting the water supply to the cooling water passages in the casting rolls.

FIG. 7 illustrates one manner in which cooling water may be supplied to the rolls. This figure illustrates a pump 51 which delivers water through supply line 52 to the ports 33 of one roll 1 and the ports 34 of the other roll so that water is delivered to the radial passages at one end of one roll and to the other end of the second roll. Water flows from the other ports through discharge line 53 to a cooling tower 54 and back to the pump through a return line 55. Since both of the rolls receive cooling water from the common supply pump 51, cooling water is delivered to both rolls at essentially the same temperature. Since temperature differences across each of the rolls are minimised by the multi-pass arrangement, very even temperature distribution across both rolls is achieved. Moreover differential expansion effects due to a temperature difference across one roll tends to be off set against movements of the other roll due to the mutual reversal of the flow direction to the two rolls. However this flow reversal is not essential to the present invention and the direction of water flow could be the same in both rolls by connecting the water supply in the manner indicated in FIG. 8. The components illustrated in FIG. 8 are the same as those shown in FIG. 7 but in this case the water supply line 52 is connected to the ports 33 of both rolls 1 and the discharge line 53 is connected to the ports 34 of both rolls.

In the illustrated roll construction, the roll body tube 20 is fixed between the stub shaft so that its circumferential wall is unsupported between the stub shafts. The elimination of the central supporting arbour included in conventional structures enables the above described problems of gap movement, gap control and arbitrary longitudinal movements of the casting rolls on be substantially eliminated. The stub shafts are not subjected to distortion or lateral forces due to thermal effects. One of the stub shafts may be fixed longitudinally and the other allowed to move in the longitudinal direction to accommodate longitudinal expansion of the roll body tube in an orderly way which can be accommodated by the pool confining plate at one end of the caster only. By using longitudinal holes in the roll body tube both for the purpose of providing cooling water passages and fixing points for the stub shafts it is possible to achieve a construction which provides a concentrated pattern of cooling passage and even temperature distribution but adequate mechanical strength. The hollow interior of the roll body tube is exposed to the flow of cooling water during operation which helps to support the roll and to maintain a very even temperature distribution.

The main parts of the casting roll tube may typically be of the order of 500 mm diameter and have a wall thickness of the order of 130 mm. To allow for adequate heat flow and mechanical strength the wall thickness should be in the range 30 mm–200 mm. The longitudinal flow passages may typically be of the order of 20 mm diameter. These may be formed by 45 equally spaced holes grouped into 15 zigzag or multi-pass channels.

What is claimed is:

1. An arbourless casting roll for casting steel strip including:

a cylindrical tube of copper or copper alloy having a wall thickness in the range of 30 mm–200 mm;

a series of longitudinal holes through the wall of the tube defining longitudinal water flow passages arranged at equal circumferential spacing around the tube;

a pair of steel stub shafts disposed one at each end of the tube and having end formations which fit snugly into the ends of the tube, and extend inwardly into the tube for a predetermined length, each end formation including a circumferential flange abutting the respective end of the tube;

a plurality of fasteners extending through the circumferential flanges of the end formations of the stub shafts into the ends of at least some of the said holes to fix the stub shafts to the tube such that the stub shafts and the tube are coaxial and the wall of the tube is unsupported between the stub shafts; and water flow ducts formed in at least one of the stub shaft end formations for flow of water to and from the longitudinal water flow passages.

2. An arbourless casting roll as claimed in claim 1, wherein the water flow ducts extend radially within both of the stub shaft end formations and through the ends of the tube to connect with the water flow passages for flow of water to and from the longitudinal water flow passages.

3. An arbourless casting roll as claimed in claim 1, wherein the longitudinal holes providing the water flow passages are circular holes which are closely spaced so as to be spaced apart by no more than the maximum diameter of the holes.

4. An arbourless casting roll as claimed in claim 1, wherein the longitudinal water flow passages are interconnected in groups such that each group of circumferentially spaced passages forms a single continuos water flow channel for flow of water back and forth between the two ends of the roll in passing from one end of the channel to the other.

5. An arbourless casting roll as claimed in claim 4, wherein the longitudinal passages are interconnected in groups of three defining three-pass water flow channels.

6. An arbourless casting roll as claimed in claim 5, wherein the water flow ducts comprise a first set of radial ducts extending through one of the stub shaft end formations to communicate with first ends of the water flow channels and a second set of radial ducts extending through the other of the stub shaft end formations to communicate with the opposite ends of those channels.

7. An arbourless casting roll as claimed in claim 4, wherein the fasteners extend into the water flow passage holes at the ends of said water flow channels.

8. An arbourless casting roll as claimed in claim 4, wherein flow passages intermediate the ends of the water flow channels are closed by end plugs.

9. An arbourless casting roll as claimed in claim 4, wherein the water flow ducts comprise a first set of radial ducts extending through one of the stub shaft end formations to communicate with first ends of the water flow channels and a second set of radial ducts extending through the other of the stub shaft end formations to communicate with the opposite ends of those channels, the fasteners extend into the water flow passages at the ends of said water flow channels, and the flow passages intermediate the ends of the water flow channels are closed by end plugs.

10. An arbourless casting roll as claimed in claim 1, wherein the ends of said tube are provided with external circumferential end notches so as to form a relatively thick walled main part defining the roll casting surface between a pair of shoulders to engage casting pool confining walls in use of the roll.

11. An arbourless casting roll as claimed in claim 10, wherein said shoulders are spaced inwardly from the stub shaft end formations.

12. Apparatus for continuously casting steel strip comprising an assembly of a pair of casting rolls forming a nip between them and each provided with water flow passages extending adjacent the outer peripheral surfaces of the rolls longitudinally of the rolls, a metal delivery nozzle for delivery of molten metal into the nip between the casting rolls to form a casting pool of molten steel supported on the casting roll surfaces above the nip, a pair of pool confining walls engaging opposite end parts of the rolls to confine the pool at the ends of the nip, roll drive means to drive the casting rolls in counter-rotational directions to produce a solidified strip of steel delivered downwardly from the nip and cooling water supply means for supply of cooling water to said longitudinal passages in the rolls, wherein each casting roll is an arbourless casting roll constructed in accordance with claim 1.

13. An arbourless casting roll as claimed in claim 1, wherein the water flow ducts extend radially within both of the shaft end formations and through ends of the tube to connect with the water flow passages for flow of water to and from the longitudinal water flow passages, and wherein the ends of said tube are provided with external circumferential end notches so as to form a relatively thick walled main part defining the roll casting surface between a pair of shoulders to engage casting pool confining walls in use of the roll, which shoulders are spaced inwardly from the radially extending water flow ducts in the stub shaft end formations at the respective ends of the tube whereby the longitudinal water flow passages extend longitudinally outwardly beyond the outer ends of the roll casting surface.

14. An arbourless casting roll as claimed in claim 13, wherein said shoulders are spaced inwardly from the inner ends of the stub shaft end formations.

15. An arbourless casting roll as claimed in claim 13, wherein the longitudinal water flow passages are interconnected in groups such that each group of circumferentially spaced passages forms a single continuous water flow channel for flow of water back and forth between the two ends of the roll in passing from one of the channels to the other, wherein the water flow ducts comprise a first set of radial ducts extending through one of the stub shaft end formations to communication with first ends of the water flow channels and a second set of radial ducts extending through the other of the stub shaft end formations to communication with the opposite ends of those channels, wherein the fasteners extend into the water flow passage holes at the ends of said water flow channels, and wherein flow passages intermediate the ends of the water flow channels are closed by end plugs.

16. An arbourless casting roll for casting steel strip including:

a cylindrical tube of copper or copper alloy having a wall thickness in the range of 30 mm–200 mm;

a series of longitudinal holes through the wall of the tube defining longitudinal waterflow passages arranged at equal circumferential spacing around the tube;

a pair of steel stub shafts disposed one at each end of the tube and having end formations, each end formation including a circumferential flange abutting the respective end of the tube;

a plurality of fasteners extending through the circumferential flanges of the end formations of the stub shafts to fix the stub shafts to the tube such that the stub shafts and the tube are coaxial and the wall of the tube is unsupported between the stub shafts; and water flow ducts formed in at least one of the stub shaft end formations for flow of water to and from the longitudinal water flow passages;

wherein the water flow ducts extend radially within both the shaft end formations and through ends of the tube to connect with the water flow passages for flow of water to and from the longitudinal water flow passages, and wherein the ends of said tube are provided with external circumferential end notches so as to form a relatively thick walled main part defining the roll casting surface between a pair of shoulders to engage casting pool confining walls in use of the roll, which shoulders are spaced inwardly from the radially extending water flow ducts in the stub shaft end formations at the respective ends of the tube whereby the longitudinal water flow passages extend longitudinally outwardly beyond the outer ends of the roll casting surface.

17. An arbourless casting roll as claimed in claim 16, wherein said shoulders are spaced inwardly from the inner ends of the stub shaft end formations.

18. An arbourless casting roll as claimed in claim 16, wherein the longitudinal water flow passages are interconnected in groups such that each group of circumferentially spaced passages forms a single continuous water flow channel for flow of water back and forth between the two ends of the roll in passing from one of the channels to the other, wherein the water flow ducts comprise a first set of radial ducts extending through one of the stub shaft end formations to communication with first ends of the water flow channels and a second set of radial ducts extending through the other of the stub shaft end formations to communication with the opposite ends of those channels, wherein the fasteners extend into the water flow passage holes at the ends of said water flow channels, and wherein flow passages intermediate the ends of the water flow channels are closed by end plugs.

* * * * *